US006763917B2

(12) United States Patent
Utsunomiya et al.

(10) Patent No.: US 6,763,917 B2
(45) Date of Patent: Jul. 20, 2004

(54) ELEVATOR VIBRATION REDUCTION APPARATUS INCLUDING A DEAD BAND FILTER

(75) Inventors: Kenji Utsunomiya, Tokyo (JP); Kenichi Okamoto, Tokyo (JP); Takashi Yumura, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 30 days.

(21) Appl. No.: 10/257,252

(22) PCT Filed: Apr. 10, 2002

(86) PCT No.: PCT/JP01/03082

§ 371 (c)(1),
(2), (4) Date: Oct. 10, 2002

(87) PCT Pub. No.: WO02/083541

PCT Pub. Date: Oct. 24, 2002

(65) Prior Publication Data

US 2003/0192745 A1 Oct. 16, 2003

(51) Int. Cl.[7] ..... B66B 1/34
(52) U.S. Cl. ..... 187/292; 187/393
(58) Field of Search ..... 187/292, 391, 187/393, 394, 409, 410, 277, 293, 295, 296

(56) References Cited

U.S. PATENT DOCUMENTS

| | | | | | |
|---|---|---|---|---|---|
| 2,828,014 | A | * | 3/1958 | Wantling | 209/326 |
| 5,652,414 | A | * | 7/1997 | Roberts et al. | 187/292 |
| 5,750,945 | A | * | 5/1998 | Fuller et al. | 187/292 |
| 6,216,824 | B1 | * | 4/2001 | Fuller et al. | 187/292 |
| 6,408,987 | B2 | * | 6/2002 | Morishita | 187/292 |

FOREIGN PATENT DOCUMENTS

| | | | | |
|---|---|---|---|---|
| GB | 2266976 A | * | 11/1993 | B66B/1/30 |
| JP | 8-26624 | | 1/1996 | |
| JP | 9-305203 | | 11/1997 | |
| WO | WO 02/083541 | | 10/2002 | |

* cited by examiner

*Primary Examiner*—Jonathan Salata
(74) *Attorney, Agent, or Firm*—Leydig, Voit & Mayer, Ltd.

(57) ABSTRACT

A vibration reduction apparatus for an elevator includes acceleration sensors for detecting vibrations of a elevator car, controllers for calculating forces to be applied to the elevator car, based an signals output by the acceleration sensors, and actuators for applying forces to the elevator car in accordance with the forces calculated by the controller. A dead band filter, which has a dead band region corresponding to noise level of the acceleration sensors, and an integrator, which integrates the signals output by the acceleration sensors after filtering by the dead band filter, are located in the acceleration sensors, or in the controllers, or between them.

18 Claims, 8 Drawing Sheets

ELEVATOR VIBRATION REDUCTION APPARATUS INCLUDING A DEAD BAND FILTER

TECHNICAL FIELD

This invention relates to a vibration reduction apparatus for an elevator which is capable of suppressing the vibrations of a car in an elevator.

BACKGROUND ART

FIG. 9 is a view showing the configuration of a known vibration reduction apparatus for an elevator disclosed in Japanese Patent Application Laid-Open No. 8-26624. An elevator cage 1 installed on a cage frame 2 engages a pair of rails 41, 42 on opposite sides of the cage frame 2 through guide devices 51–54 mounted thereon, so that an elevator is driven to move up and down along the rails 41, 42 by moving a wire rope (not shown) hanging the cage frame 2 in a vertical direction by means of a winch (not shown).

The guide devices 51–54 are arranged at four corners on opposite upper and lower sides of the cage frame 2. The guide devices 51–54 are provided with guide rollers 71–74 and actuators 81–84, respectively, which act as vibration reducers for suppressing vibrations of the car. The actuators 81–84 may be in the form of contactless actuators which are constituted by electromagnets, etc.

Information about the vibrations detected by acceleration sensors 61, 62 mounted on the cage frame 2 is sent to a controller 9 including control units 9*a*, 9*b* of the same configuration, where instruction values of control forces to be applied to the car for vibration reduction is calculated. The instruction values are sent to current amplifiers 93, from which driving currents are supplied to the actuators 81–84, respectively, based on the instruction values. At this time, the actuators 81–84 generate forces corresponding to horizontal vibrations of the car and apply then to the guide rails 41, 42 thereby to suppress transverse vibrations of the car.

Within the controller 9, acceleration signals are converted into corresponding speed signals by means of integrators 92 and then output to the current amplifiers 93 as instruction values. As a result, by applying to the car a force of the same magnitude and of the opposite direction with respect to the horizontal speed of the car, a damping force is added to the car, thus suppressing vibrations of the car.

Here, note that 91*a*–91*d* in the controller 9 designate amplifiers, and 94 designates a phase inverter. In addition, 31 and 32 designate vibration preventing rubber members disposed between the elevator cage 1 and the cage frame 2.

As the known vibration reduction apparatus for an elevator is constructed in the above-described manner, there arise the following problems. That is, drift noise having low frequencies contained in the signals of the acceleration sensors is increased or amplified by integrating the acceleration sensor signals in the controller, and a large low frequency error might be superposed on and hence contained in each instruction value. Thus, the current amplifiers for driving the actuators each require a large power supply capacity. In addition, when the car is temporarily stopped at a floor during operation of the elevator, the car might be caused to vibrate by the noise in the acceleration sensor outputs, thus resulting in deteriorated riding comfort.

The present invention is intended to obviate the above-mentioned problems, and to produce a vibration reduction apparatus for an elevator which is improved in vibration suppression.

DISCLOSURE OF THE INVENTION

The present invention resides in a vibration reduction apparatus for an elevator which includes an acceleration sensor for detecting vibrations of a car, a controller for calculating a force to be applied to the car based on a signal of the acceleration sensor, and an actuator for applying a force to the car in accordance with the calculation result of the controller. The vibration reduction apparatus for an elevator is characterized in that a dead band filter, which has a prescribed dead band region corresponding to a noise level of the acceleration sensor, and an integrator, which integrates the signal of the acceleration sensor after having passed through the dead band filter, are provided between the acceleration sensor and the controller.

In addition, the apparatus is characterized in that the dead band filter and the integrator are provided in the controller.

Moreover, the apparatus is characterized in that the dead band filter has a dead band region in a range between ±2.5 $cm/s^2$.

Further, the apparatus is characterized in that the controller is provided with a high-pass filter disposed downstream of the integrator.

Furthermore, the apparatus is characterized in that the controller is provided with means for forcedly adjusting the signal after integrated to zero during the car is stopped at a floor.

Still further, the apparatus is characterized in that the acceleration sensor comprises an acceleration sensor having a semiconductor built therein, and the dead band filter has a dead band region in a range between ±6 $cm/s^2$.

Moreover, the apparatus is characterized in that the car is movable in a vertical direction along guide rails, with the actuator being arranged between the car and the guide rails.

In addition, the apparatus is characterized in that the car is provided with guide rollers for guiding the car along the guide rails so as to permit the car to move in the vertical direction therealong, with the actuator being arranged between the car and the guide rollers.

Moreover, the apparatus is characterized in that the car includes an elevator cage and a cage frame flexibly supporting the elevator cage, with the actuator being arranged between the elevator cage and the cage frame.

The present invention improves the vibration suppression performance in the vibration reduction apparatus for an elevator by adding the dead band filter or the high-pass filter in the controller which operates the actuator, for instance.

BEST MODE FOR CARRYING OUT THE INVENTION

Embodiment 1.

Figure 1:
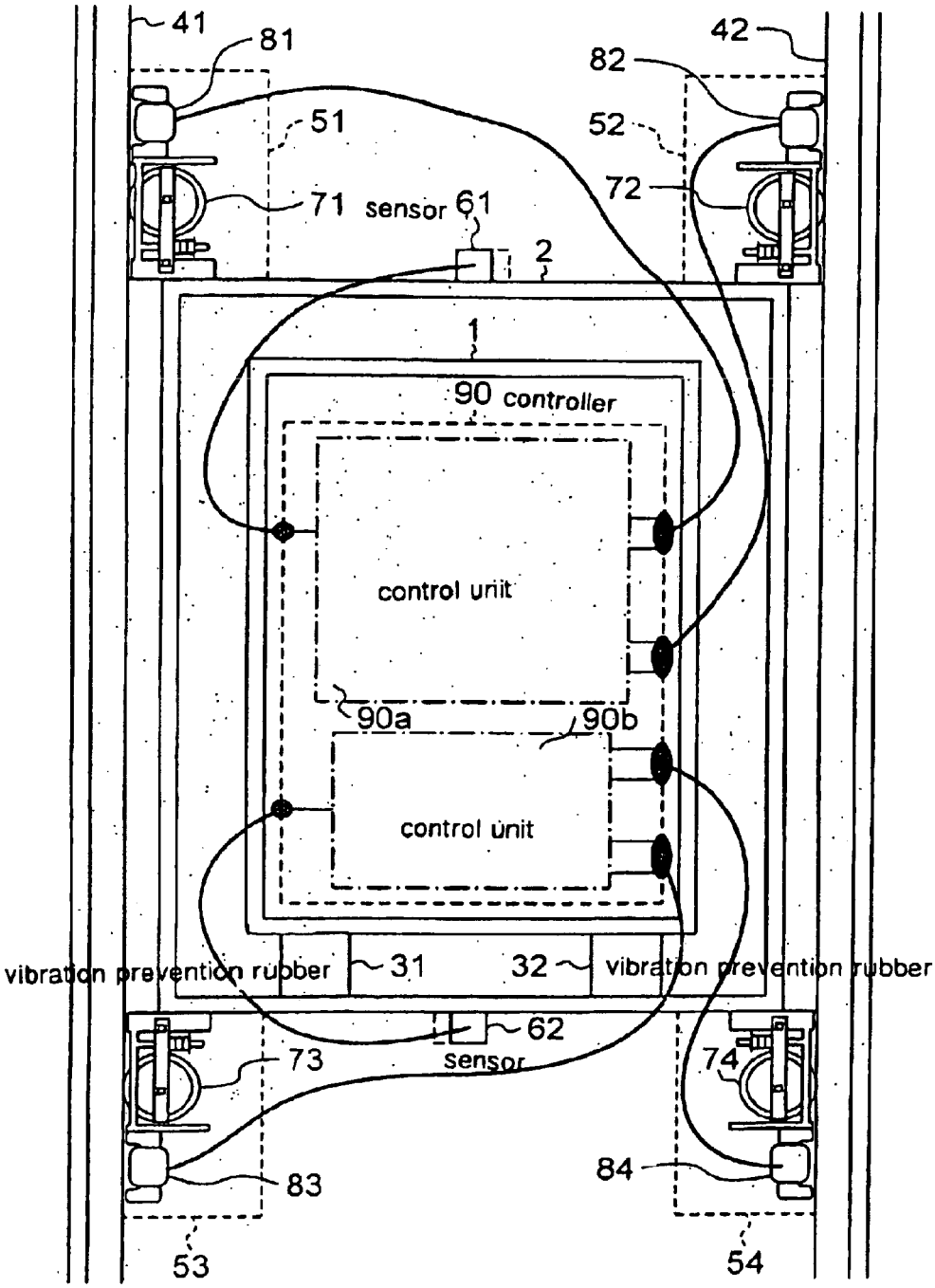
FIG. 1 is a view showing the configuration of a vibration reduction apparatus for an elevator according to one embodiment of the present invention.

FIG. 1 is a view which shows the configuration of a vibration reduction apparatus for an elevator according to one embodiment of the present invention. The same or corresponding parts of this embodiment as those in the known apparatus are identified by the same symbols, while omitting an explanation thereof. 90 designates a controller which is comprised of control units 90*a*, 90*b* of the same configuration according to the present invention, and the other parts of this embodiment are basically the same as those in the known apparatus. It is to be noted that a car generally includes an elevator cage 1 and a cage frame 2.

Figure 2:
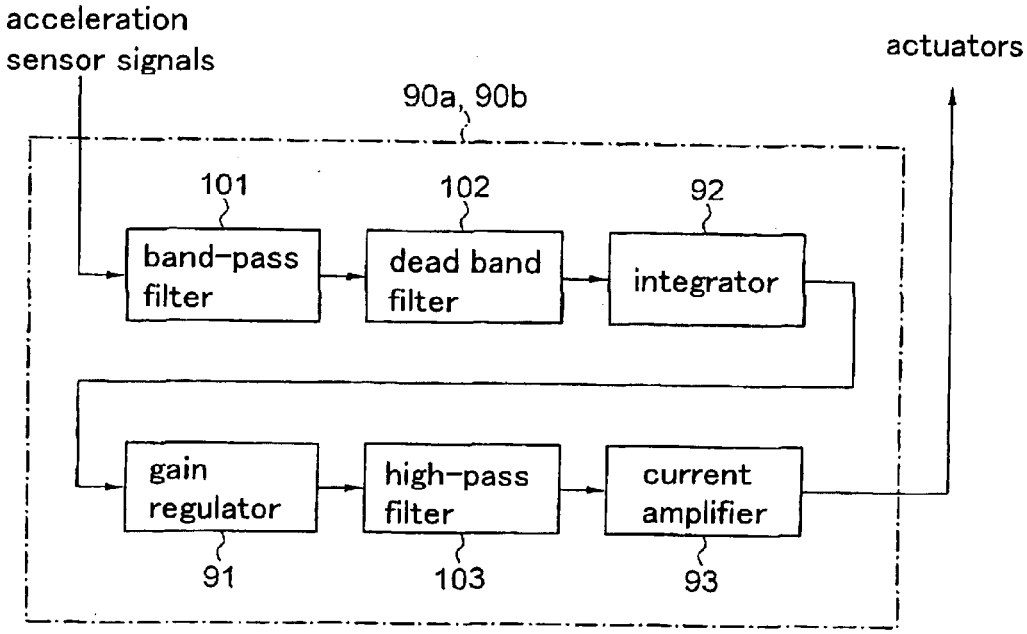
FIG. 2 is a block diagram showing the circuit structure of a controller in a first embodiment of the present invention.

FIG. 2 is a block diagram which shows the circuit structure of the control units 90*a*, 90*b* of the controller 90, which is an essential portion of the first embodiment of the present invention. In FIG. 2, 101 designates a band-pass filter; 102 a dead band filter; 92 an integrator; 91 a gain regulator; 103 a high-pass filter; and 93 a current amplifier.

Figure 3:
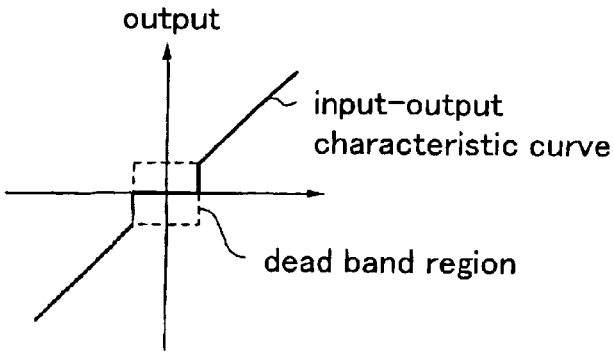
FIG. 3 is a view showing the input-output characteristic of a dead band filter according to the present invention.

As illustrated in FIG. 2, an acceleration sensor signal representative of a car acceleration detected by each of the acceleration sensors 61, 62 is first subjected to filtering such that low-frequency signal components and high-frequency signal components useless for control are filtered by the band-pass filter 101 to be converted into a signal containing frequencies easily perceived by human beings, e.g., a signal containing frequency components in the range of 0.1 Hz–20 Hz. In addition, noise signal components in a prescribed dead band region are filtered by the dead band filter 102 having an input-output characteristic, as shown in FIG. 3. Thereafter, the signal thus filtered is converted into an absolute velocity signal by means of the integrator 92.

Subsequently, a control command value is amplified by the gain regulator 91. Then, low-frequency components are filtered by the high-pass filter 103. In accordance with the signals having been subjected to these processes, currents are supplied from the amplifiers 93 to the actuators 81–84 for driving thereof.

Figure 4:
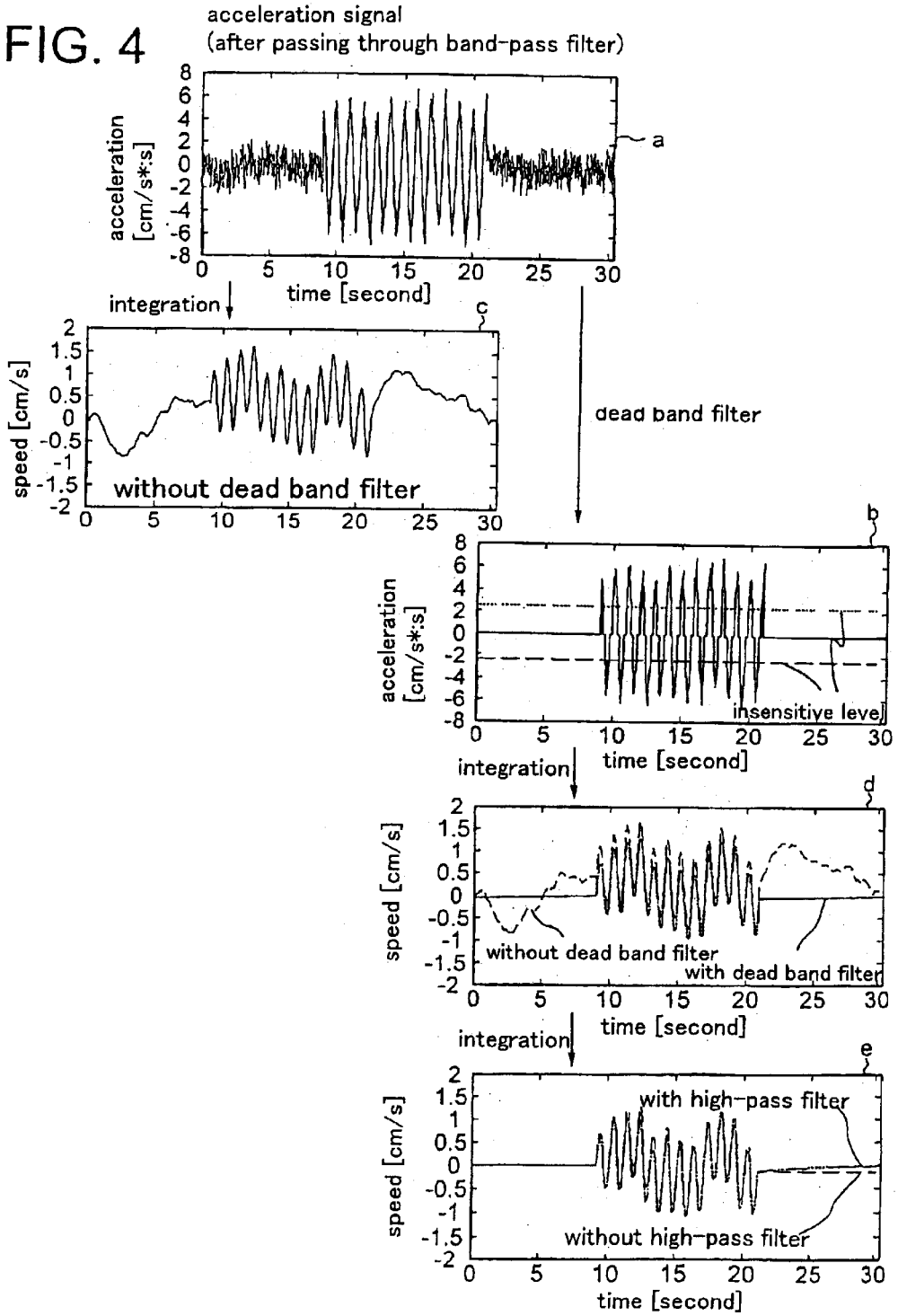
FIG. 4 is a view explaining the effects of the present invention.

At this time, insensitive or dead band levels of each dead band filter 102 are set to $\pm 2.5$ cm/s$^2$ for instance, as shown in b of FIG. 4. These values are set so as to be able to cut off or interrupted low-frequency drift noise of the acceleration sensors 61, 62 without deteriorating the vibration suppression performance.

Accordingly, the noise acceleration signals below a prescribed input level are interrupted by means of the functions of the dead band filters 102, as shown in a–b of FIG. 4. Therefore, the drift noise components of the acceleration sensor signals are prevented from being increased or amplified through integration, as shown in c of FIG. 4. When the car is stopped, the signals sent to the current amplifiers 93 become a prescribed value, as shown in d of FIG. 4.

Moreover, since only minute values equal to or less than the prescribed value are filtered, the control command values during vibrations of the elevator do not substantially fluctuate or change. Thus, the vibration suppression performance of the apparatus during running of the car is kept at a high level without causing swinging movements or vibrations of the car during stoppage thereof. As a result, it is possible to provide the elevator with excellent riding comfort. In addition, the capacitance and power consumption of each current amplifier 93 can be reduced.

Moreover, the control output signals, which become the prescribed value when the car is stopped, are settled or converged to zero without fail by the effects of the high-pass filters 103, as shown in e of FIG. 4, and hence the current amplifiers 93 does not supply useless DC component electric power to the actuators 81–84, thus making it possible to reduce power consumption. In addition, when the actuators 81–84 generate forces continuously acting in one direction, there arises a possibility that the car of the elevator may be caused to tilt or incline, thus giving rise to interference with various safety devices (not shown) installed in the vertical passage, though not affecting the riding comfort. However, this can be prevented by the effects of the high-pass filters 103.

Embodiment 2.

Figure 5:
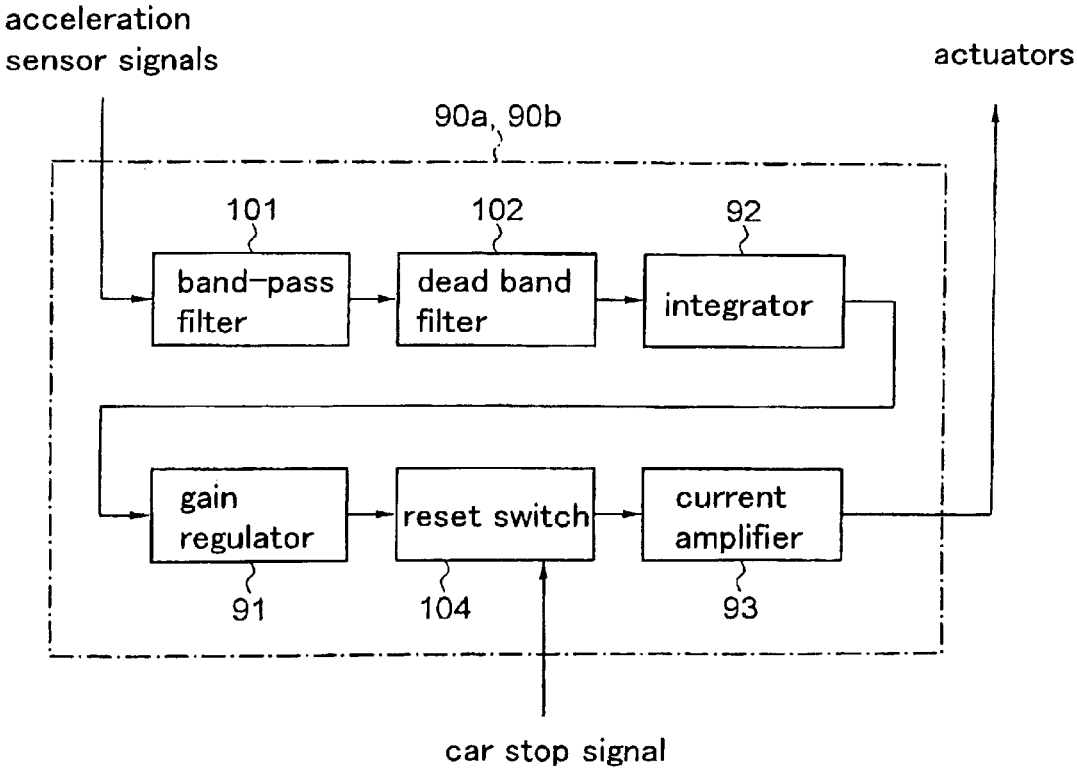
FIG. 5 is a block diagram showing the circuit structure of a controller in a second embodiment of the present invention.

FIG. 5 is a block diagram which shows the circuit structure in control units 90*a*, 90*b* of a controller 90 in a vibration reduction apparatus for an elevator according to another embodiment of the present invention and 90*b*. In this embodiment, the high-pass filter 103 in each control unit of the above-mentioned first embodiment is replaced by a reset switch 104. In this case, when the car is in its stopped state, the reset switch 104, which is a means for forcedly adjusting a signal after integrated to zero, forcedly adjusts a control output signal to zero, and hence similar effects are obtained as in the case where the high-pass filter 103 shown in the first embodiment is used.

In addition, the use of the high-pass filter 103 tends to worsen control stability to a more or less extent since phase shifts may be generated in the vicinity of the frequencies to be filtered. However, in the case of provision of the reset switch 104, there is no phase shift, so stability is not worsened at all.

Here, note that it is necessary to input a car stop signal indicative of the stoppage of the car to the reset switch 104. For such a car stop signal, there may be used, for example, a signal from a rotary encoder (not shown) which is coupled with the rotation shaft of a winch for rolling up a wire rope hanging the cage frame 2 and which detects the speed of the elevator cage 1, or a lock signal which serves to lock the elevator cage 1 when the elevator cage 1 is stopped at a floor.

Embodiment 3.

Moreover, in case where semiconductor type acceleration sensors having cheap semiconductors built therein are used as the acceleration sensors 61, 62, noise might not be able to be cut off or interrupted completely if the insensitive or dead band levels of the dead band filter 102 are set to be $\pm 2.5$ cm/s$^2$. At this time, the insensitive or dead band levels in the above-mentioned first and second embodiments are changed into a range between $\pm 6$ cm/s$^2$, whereby cheap semiconductor type acceleration sensors can be used, thus making it possible to manufacture the vibration reduction apparatus at low cost though the vibration suppression performance thereof may be reduced to some extent.

Embodiment 4.

Figure 6:
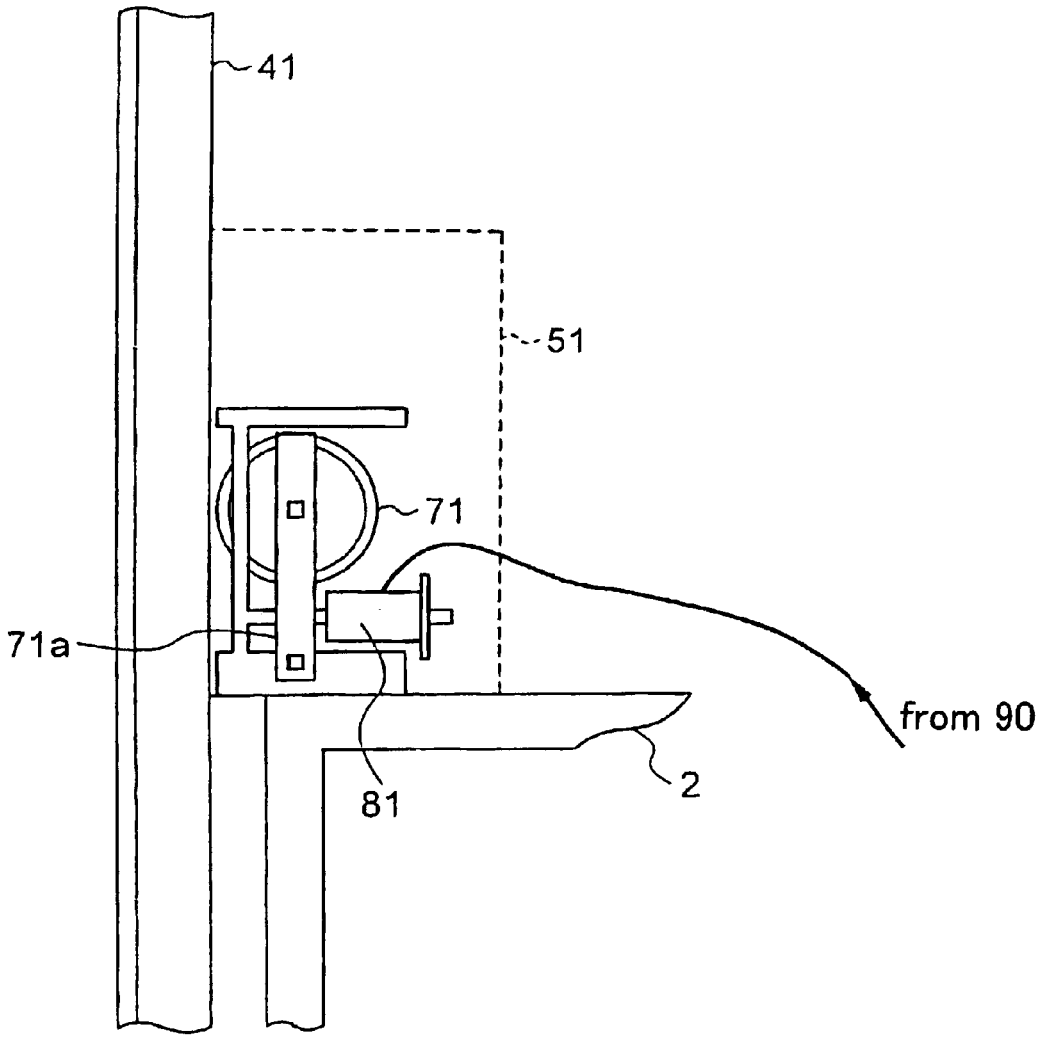
FIG. 6 is a view showing a modification in a fourth embodiment of the present invention.
Figure 7:
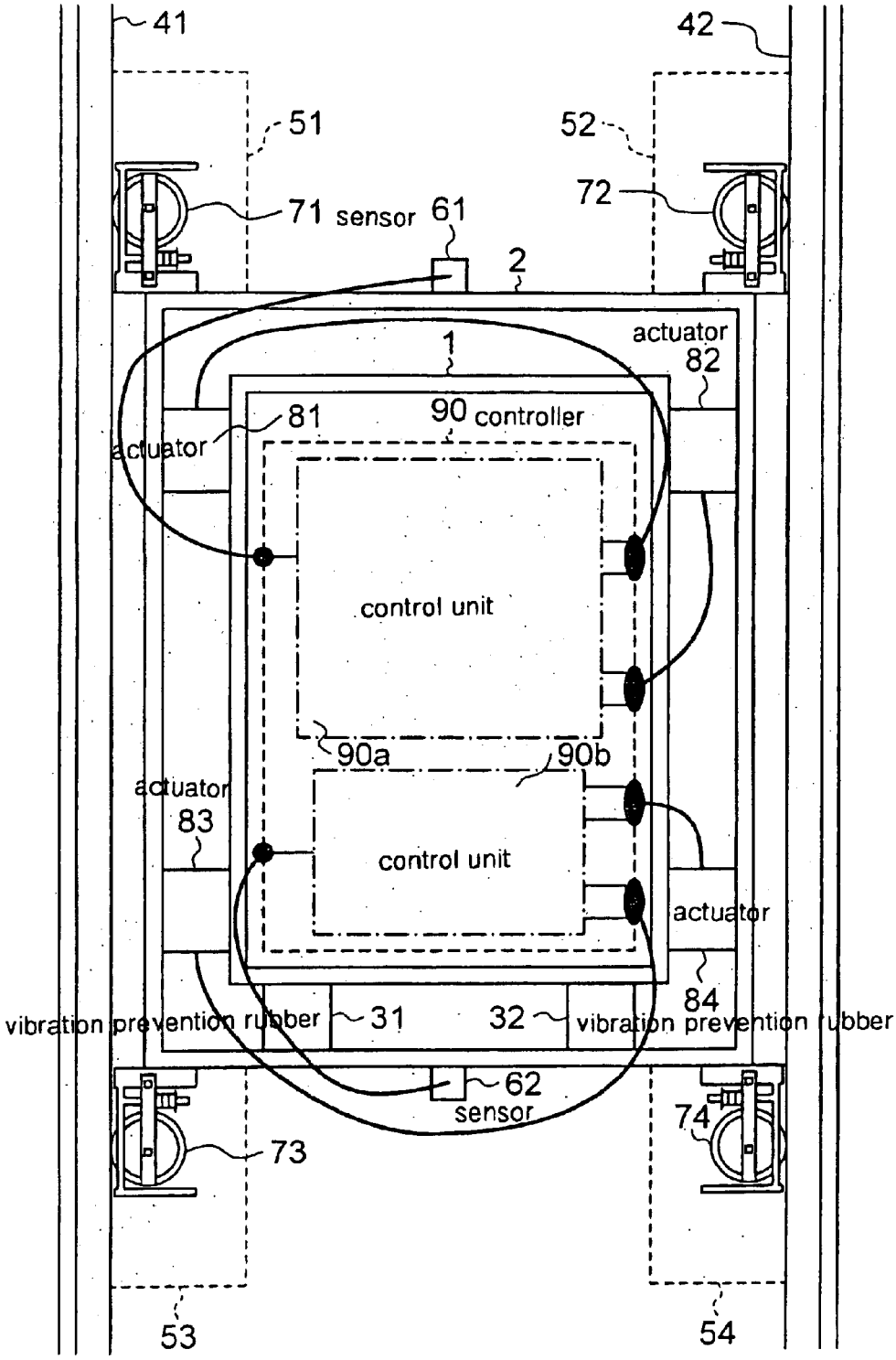
FIG. 7 is a view showing another modification in the fourth embodiment of the present invention.

Furthermore, although in the above-mentioned embodiments, the actuators are installed on the guide devices, respectively, for controlling the horizontal vibrations of the elevator, the present invention is not limited to such a case. For instance, actuators may be arranged between the cage frame 2 and the rollers 71–74, as shown in FIG. 6. In this case, the arrangement may be such that a support arm 71*a*, which supports a corresponding roller 71 in such a manner as to be movable to the right and left on the drawing sheet, is urged toward a corresponding guide rail 41 under the action of a corresponding actuator 81.

In addition, actuators may be arranged between the elevator cage 1 and the cage frame 2, as shown by 81–84 in FIG.

Figure 8:
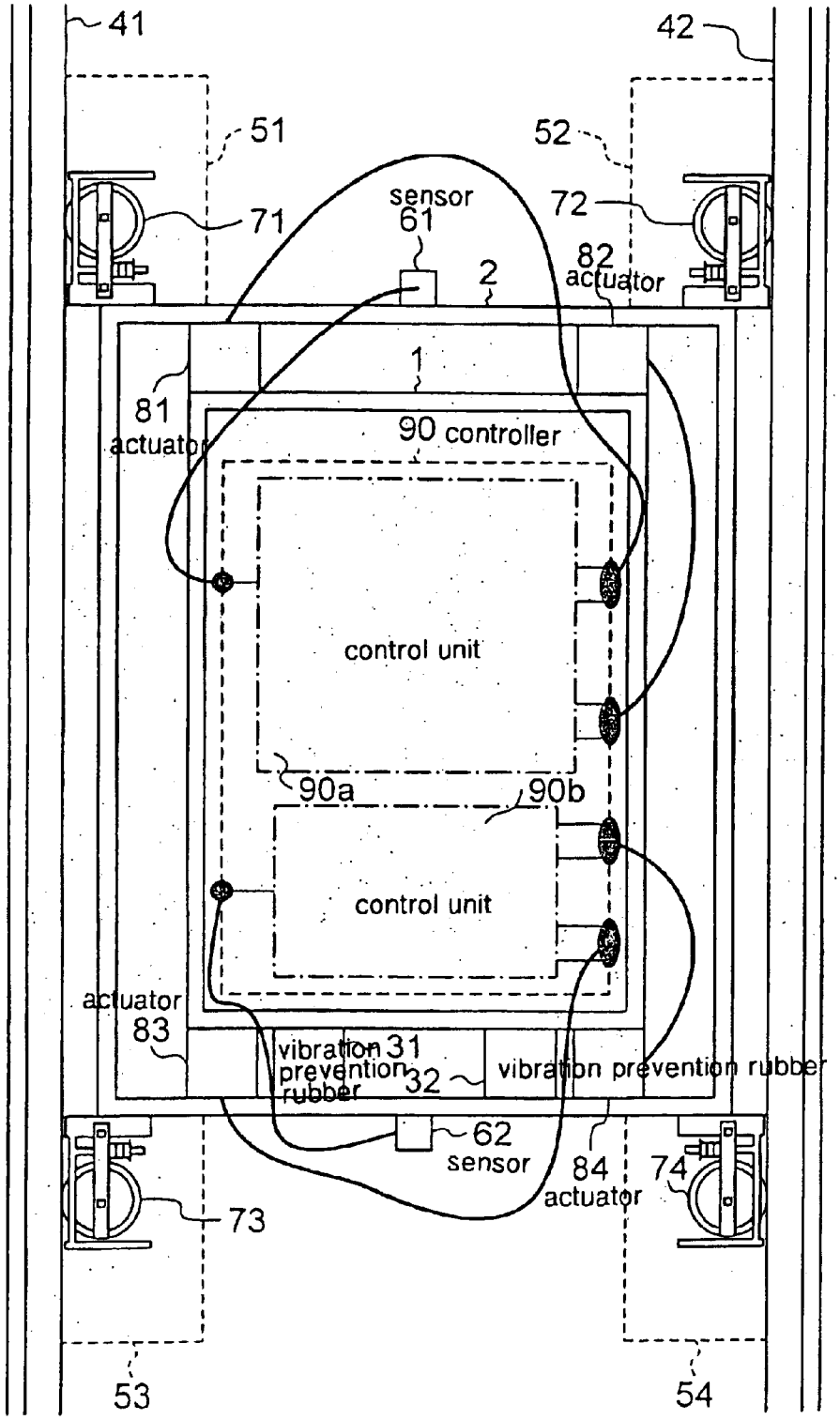
FIG. 8 is a view showing a further modification in the fourth embodiment of the present invention.
Figure 9:
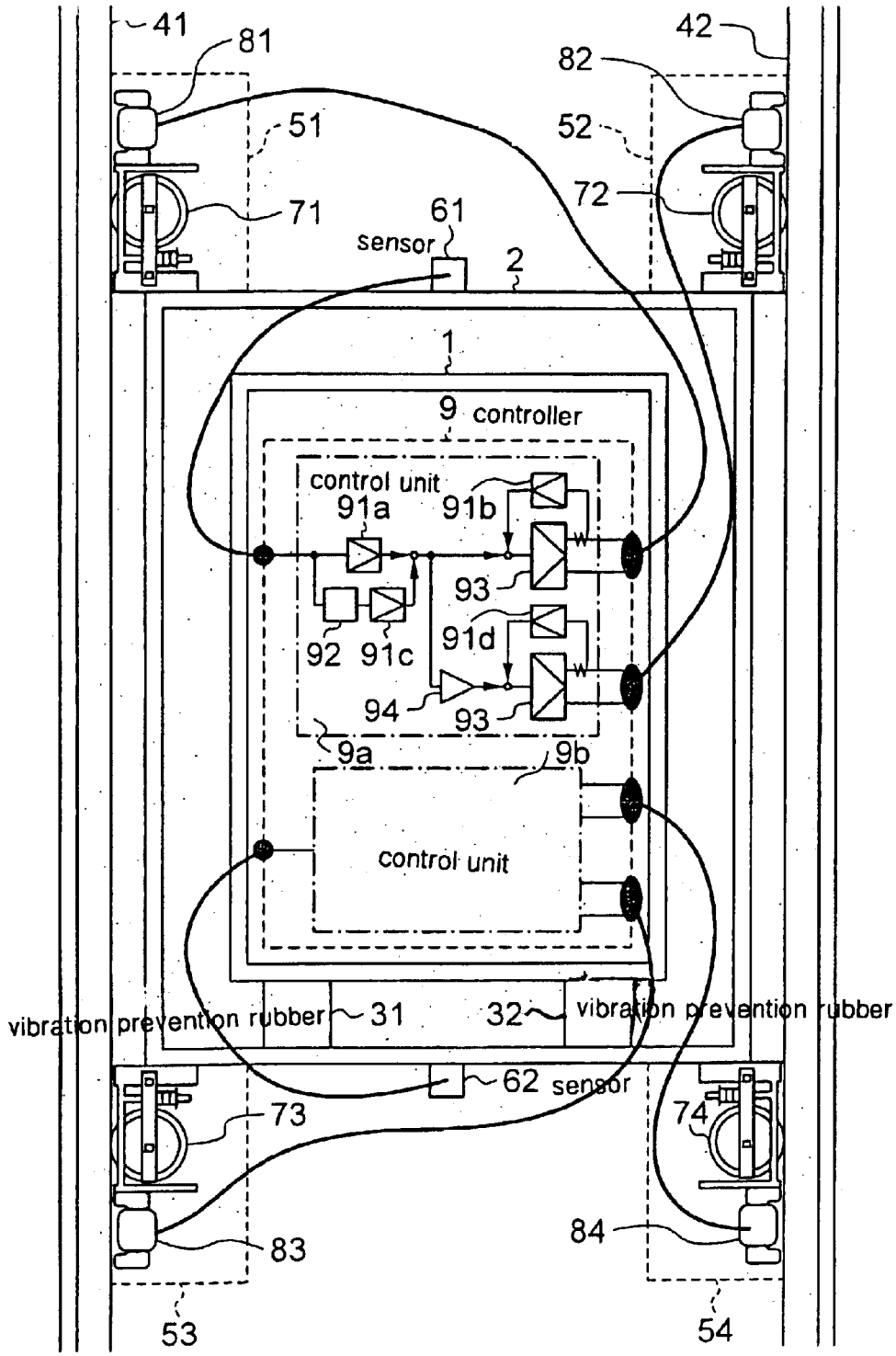
FIG. 9 PRIOR ART
FIG. 9 is a view showing the configuration of a known vibration reduction apparatus for an elevator.

7. Further, the present invention is not limited to the case where the horizontal or transverse vibrations of the car are to be controlled, but may be applicable to the case where longitudinal vibrations of the car are to be controlled. In such a case, actuators are arranged between an upper portion and a lower portion of the elevator cage 1 and the cage frame 2, as shown by 81–84 in FIG. 8, for instance. Here, note that in these cases, it is necessary to support the elevator cage 1 onto the cage frame 2 with a certain degree of flexibility.

Moreover, the vibration reduction may be carried out in a total manner by using a controller and actuators for controlling the transverse vibrations as well as a controller and actuators for controlling the longitudinal vibrations.

Still further, although in the above-mentioned respective embodiments, the dead band filters and the integrators are arranged in the controller, the present invention is not limited to this. If the signals of the acceleration sensors are made to pass through the dead band filters and the integrators, the dead band filters and the integrators may be arranged anywhere between the acceleration sensors and the controller. For instance, only the dead band filters or both the dead band filters and the integrators may be arranged on the acceleration sensor side, as shown by broken lines in FIG. 1.

INDUSTRIAL APPLICABILITY

As described in the foregoing, according to the present invention, a dead band filter is provided in a controller for controlling the vibrations of an elevator, so that the riding comfort of the elevator can be improved while maintaining high vibration suppression performance during running of a car without causing transverse vibrations thereof when the car is stopped. In addition, a current amplifier does not output useless electric power during stoppage of the car, whereby the capacitance of the current amplifier can be reduced, thus making it possible to manufacture the controller at low cost and reduce power consumption during operation of the elevator.

Moreover, by setting the insensitive or dead band levels of the dead band filter to be ±2.5 cm/s$^2$, low-frequency drift noise in an acceleration sensor output can be cut off or interrupted without deteriorating the vibration suppression performance.

In addition, by providing a high-pass filter within the controller, a control command value is settled or converged to zero without fail, thus making it possible to further reduce the power consumption of the current amplifier. Further, there takes place no inclination of the car, so interference with various safety devices in a vertical passage for the car will not be caused, thus enabling the elevator to be operated in a safe manner.

Furthermore, in case where a reset switch in the form of means for forcedly adjusting a signal after integrated to zero during stoppage of the car is provided in the controller in place of the high-pass filter, there will be obtained the same effects as in the case of the high-pass filter being provided, without causing any phase shift. Thus, stability in control is never deteriorated.

Still further, in case where an acceleration sensor having a semiconductor built therein is used as the acceleration sensor, by setting the insensitive or dead band region of the dead band filter to be between ±6 cm/s$^2$, a cheap semiconductor type acceleration sensor can be utilized though the vibration suppression performance is reduced to some extent. Accordingly, it is possible to provide the vibration reduction apparatus at low cost.

Besides, an actuator can be arranged between the car and the guide rails, or between the car and guide rollers, or between an elevator cage and a cage frame, so applicability of the present invention is extended.

What is claimed is:

1. A vibration reduction apparatus for an elevator including:

an acceleration sensor for detecting vibrations of an elevator car;

a controller for calculating a force to be applied to the elevator car based on a signal output by said acceleration sensor;

an actuator for applying a force to the elevator car in accordance with the force calculated by said controller;

a dead band filter, which has a dead band region corresponding tonoise level of said acceleration sensor; and an integrator which integrates the signal output by said acceleration sensor after filtering by said dead band filter.

2. The vibration reduction apparatus for an elevator as set forth in claim 1, wherein said dead band filter and said integrator are located within said controller.

3. The vibration reduction apparatus for an elevator as set forth in claim 1, wherein said dead band filter has a dead band region in a range between ±2.5 cm/s$^2$.

4. The vibration reduction apparatus for an elevator as set forth in claim 1, wherein said controller includes a high-pass filter following said integrator.

5. The vibration reduction apparatus for an elevator as set forth in claim 1, wherein said controller includes means for forcedly adjusting the signal after the signal is integrated to zero while the elevator car is stopped at a floor.

6. The vibration reduction apparatus for an elevator as set forth in claim 1, wherein said acceleration sensor comprises a semiconductor acceleration sensor, and said dead band filter has a dead band region in a range between ±6 cm/s$^2$.

7. The vibration reduction apparatus for an elevator as set forth in claim 1, wherein the elevator car is movable up and down along guide rails, and said actuator is located between the elevator car and the guide rails.

8. The vibration reduction apparatus for an elevator as set forth in claim 1, wherein the elevator car includes guide rollers for guiding the elevator car along guide rails as the elevator car moves up and down along the guide rails, and said actuator is located between the elevator car and the guide rollers.

9. The vibration reduction apparatus for an elevator as set forth in claim 1, wherein the elevator car includes an elevator cage and a cage frame which flexibly support the elevator car, and said actuator is located between the elevator car and the car frame.

10. The vibration reduction apparatus for an elevator as set forth in claim 2 wherein said dead band filter has a dead band region in a range between ±2.5 cm/s$^2$.

11. The vibration reduction apparatus for an elevator as set forth in claim 2 wherein said controller includes a high-pass filter forcing said integrator.

12. The vibration reduction apparatus for an elevator as set forth in claim 2 wherein said controller includes means for forcedly adjusting the signal after the signal is integrated to zero while the elevator car is stopped at a floor.

13. The vibration reduction apparatus for an elevator as set forth in claim 2 wherein said acceleration sensor comprises a semiconductor acceleration sensor, and said dead band filter has a dead band region in a range between ±6 cm/s$^2$.

14. The vibration reduction apparatus for an elevator as set forth in claim 2 wherein the elevator car is movable up and down along guide rails, and said actuator is located between the elevator car and the guide rails.

15. The vibration reduction apparatus for an elevator as set forth in claim 2 wherein the elevator car includes guide rollers for guiding the elevator car along guide rails as the elevator car moves up and down along the guide rails, and said actuator is located between the elevator car and the guide rollers.

16. The vibration reduction apparatus for an elevator as set forth in claim 2 wherein the elevator car includes an elevator cage and a cage frame which flexibly support the elevator car, and said actuator is located between the elevator car and the car frame.

17. The vibration reduction apparatus for an elevator as set forth in claim 1 wherein said dead band filter and said integrator are located between said acceleration sensor and said controller.

18. The vibration reduction apparatus for an elevator as set forth in claim 2 wherein said dead band filter and said integrator are located between said acceleration sensor and said controller.

* * * * *

UNITED STATES PATENT AND TRADEMARK OFFICE

CERTIFICATE OF CORRECTION

PATENT NO. : 6,763,917 B2
DATED : July 20, 2004
INVENTOR(S) : Utsunomiya et al.

It is certified that error appears in the above-identified patent and that said Letters Patent is hereby corrected as shown below:

Title page,
Item [22], change "PCT Filed: Apr. 10, 2002" to -- PCT Filed: Apr. 10, 2001 --

Signed and Sealed this

Twenty-first Day of December, 2004

JON W. DUDAS
*Director of the United States Patent and Trademark Office*